United States Patent [19]

Kaiser et al.

[11] Patent Number: 4,712,602

[45] Date of Patent: Dec. 15, 1987

[54] POOL-LEVEL SENSING PROBE AND AUTOMATIC LEVEL CONTROL FOR TWIN-BELT CONTINUOUS METAL CASTING MACHINES

[75] Inventors: Timothy D. Kaiser, Colchester; Gary P. Ackel, Burlington, both of Vt.

[73] Assignee: Hazelett Strip-Casting Corporation, Colchester, Vt.

[21] Appl. No.: 906,256

[22] Filed: Sep. 11, 1986

[51] Int. Cl.[4] ..... B22D 11/18

[52] U.S. Cl. ..... 164/453; 164/451; 164/481

[58] Field of Search ..... 164/431–433, 164/449, 453, 480–482, 451, 150

[56] References Cited

U.S. PATENT DOCUMENTS 3,921,697 11/1975 Petry ..... 164/453
4,276,921 7/1981 Lemmens et al. ..... 164/453

FOREIGN PATENT DOCUMENTS 123450 10/1984 European Pat. Off. ..... 164/453

*Primary Examiner*—M. Jordan
*Assistant Examiner*—Richard K. Seidel
*Attorney, Agent, or Firm*—Parmelee, Bollinger & Bramblett

[57] ABSTRACT

In continuous metal-casting machines utilizing one or more thin flexible belts as mold surfaces, a suitably placed thermal sensing probe which contacts the reverse side of a casting belt results in enhanced control of molten-metal pool levels, in contrast to the earlier systems where a series of separately monitored probes were disposed serially against the belt from upstream to downstream, each of which registered a separately monitored "yes" or "no" signal. In accordance with the present invention, an intermediate temperature is selected as the control point, at one location in the mold. If the pool of molten metal rises above the optimum level, the sensing probe will register a correspondingly increased temperature. If the pool falls below optimum, the probe will register a cooler temperature. The resulting electrical signals are processed by an electronic circuit. The result may be displayed for manual control of metal feed or machine speed, or a resulting control signal may be employed to control automatically the flow of molten metal into the mold cavity or, alternatively, to control the speed of the casting belts which convey metal through the casting machine. Multiple sensing probes disposed serially along the direction of motion of the moving mold afford a greater physical length of effectiveness of pool-level control when they are wired in series or otherwise related so that their signals are summed up to result in only one combined single-channel signal to be monitored or to be used for automatic control.

18 Claims, 19 Drawing Figures

FIG. 4
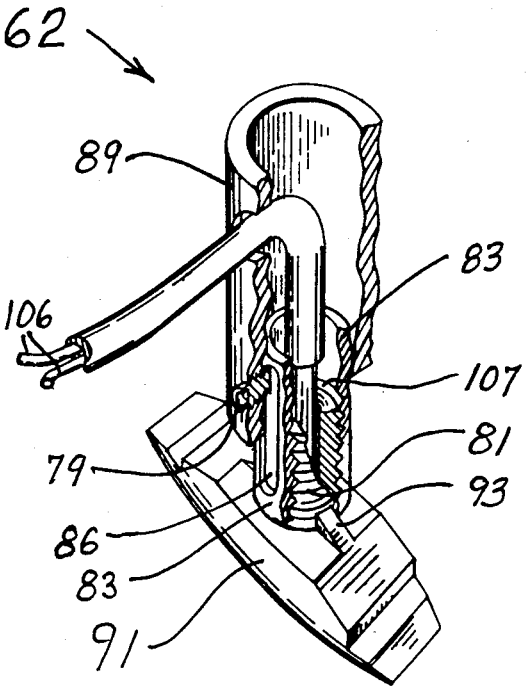
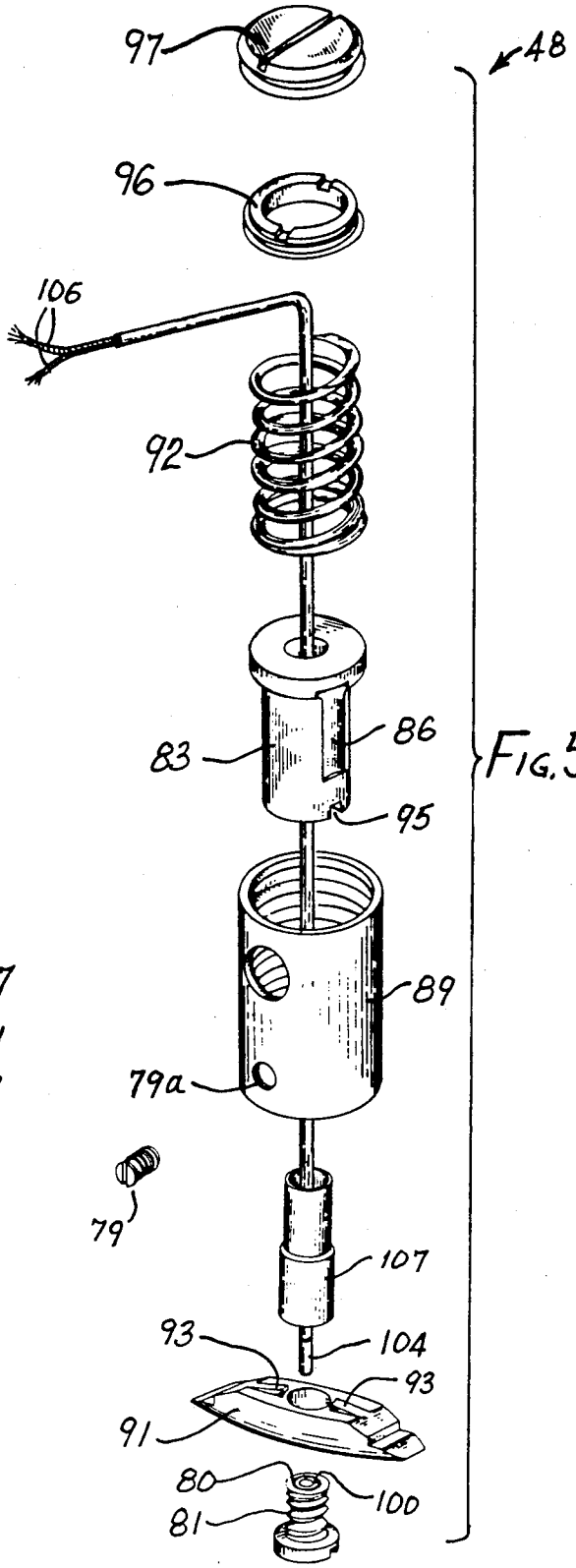
FIG. 5

POOL-LEVEL SENSING PROBE AND AUTOMATIC LEVEL CONTROL FOR TWIN-BELT CONTINUOUS METAL CASTING MACHINES

BACKGROUND OF THE INVENTION

Continuous casting machines which utilize at least one relatively thin flexible endless belt, have long been is use. Twin-belt continuous metal casting machines have been described generally in U.S. Pats. Nos. 2,904,860, 3,036,348, 3,041,686, 3,123,874, and 3,167,830.

The term "twin-belt casting machine" as used herein is understood to include not only machines with a straight casting section but also machines in which the two belts, normally of metal and constituting the mold, follow an arcuate path through the casting section. For example, one belt of a pair of belts may constitute the periphery of a wheel as described in prior U.S. Pat. No. 3,785,428; this results in a shape of casting path which is a sector of a circle. Or with another arrangement, the arcuate path may be of variable curvature, rather like the curve of a banana, as in U.S. Pat. No. 4,505,319 of Kimura, assigned to Hitachi.

Earlier apparatus which is relevant to the present invention is disclosed in U.S. Pat. Nos. 3,864,973 and 3,921,697, both patents being issued to Charles J. Petry and assinged to the same assignee as the present invention. Both of these patents are incorporated herein by reference. Both patents concern a multiplicity of independently signalling thermal probes or sensors or detectors for the sensing of the level or depth or extent of the pool of molten metal in twin-belt continuous casting machines. These multiple probes are in bearing or skating contact with the reverse or water-cooled side of a thin flexible casting belt, which is normally of metal. If molten metal is touching the casting belt in an area on the front side of the belt at a point opposite the sensing probe, the probe becomes heated to a temperature as high as a difference of 90 degrees F. or 50 degrees C. ($\Delta T$) above the ambient temperature of the cool to tepid coolant water against the belt, though such heating is not instantaneous. A jacket of copper or other efficiently heat-conducting material is used to effect optimum transfer of heat to the thermal sensor within. In accord with the present invention, the probe has a flat-faced external shoe which is streamlined to minimize the disturbance to the flow of coolant. The probe should be flexibly mounted in a direction perpendicular to the belt, in order to maintain reliable and full bearing contact of its shoe against the reverse side of the casting belt. This flexible mounting may be accomplished notably by a suitably disposed helical spring or by a cantilever spring mount.

Three modes of pouring of molten metal are used in connection with twin-belt continuous casting machines: injection feeding (FIG. 13), closed-pool feeding (FIGS. 14 and 14A), and open-pool feeding (FIG. 15). The signal or information afforded by the above-mentioned thermal sensing probes has proved useful in the operation of twin-belt continuous casting machines, especially those operating under difficult conditions in all three pouring modes and most especially where optical means of detecting the level of the pool of molten metal within the mold have proven difficult or impossible. An optical system is described in U.S. Pat. No. 4,276,921 of Lemmens and Gielen.

We refer herein to the upper and lower casting belts. But in the case of a vertical caster, we mean simply the two belts or, again, in the case of a twin-belt wheel caster, the outer and inner belts. In many installations other than a twin-belt wheel caster, the two belts converge directly opposite each other as occurs around opposed upstream pulleys. This convergence defines the entrance or input region IR (FIG. 1) to the casting region. In such installations, molten metal M (FIG. 13) is usually fed into the casting machine through a close-fitting nosepiece (or "nozzle" or "snout") N (FIG. 13) which semi-seals the entrance to a clearance typically of 0.010 to 0.020 inch (0.25 to 0.50 mm) more or less, as is done in the casting of aluminum. When the casting space or mold cavity C within the casting machine is filled with molten or freezing metal thereby, the technique is called "injection feeding." This term is applied only to instances where the casting region of the machine is in this way entirely filled with freezing metal, with no void or gaseous space G above the metal inside. This injection feeding mode is illustrated in FIG. 13. The high surface tension notably of aluminum, and the tenacity of its oxide films, enable the pool of metal to fill up agains a not-too-thick nosepiece or nozzle N without backward leakage and consequent freezing into fins. Such congealing leakage would of course damage the nosepiece. In injection feeding, as shown in FIG. 13, control of the pool level within the mold cavity is by definition not applicable. But control of the level of the molten aluminum M in the large open tundish T (FIG. 13), which feeds the casting region C, is indeed critical, since too high a head there will cause high head within the mold region itself which is apt to cause finning through the gaps and damage to the nosepiece, thereby interrupting the entire continuous casting process up and down the line, forcing a restart of all operations from metal feeding to in-line rolling.

There are times when it may be well to create a smallish gas-filled void or cavity G (FIG. 14) inside the mold, above the pool P of molten metal M, in order (1) that the head of metal will not cause flashing of the metal under the metal-feeding nosepiece N and (2) in order that an inert atmosphere be assured to be in contact with the molten pool, as described in U.S. patent applications Ser. Nos. 372,459 dated Apr. 28, 1982, and 631,595 dated July 17, 1984. This cavity G may be desirable for instance in the continuous casting of a section with a substantial vertical thickness, like aluminum bar (as opposed to relatively thin slab). The pool P is maintained at a level below the point at which the void G would be replaced by molten metal. In this way, the molten metal M does not touch the full vertical height of the blunt exit end E of the nosepiece or snout. This technique is called "closed pool feeding" and is illustrated in FIG. 14. While the apparatus appears to suggest injection as in FIG. 13, the metal flowing immediately out from the nosepiece end E in closed-pool feeding encounters neither more molten metal nor the back pressure inherent in true injection feeding; hence, the term "injection" is not used herein for the closed-pool feeding technique.

In yet other twin-belt casting machine applications, as shown in FIG. 15, the lower (or inner) casting belt is so disposed or offset relative to the opposite or upper belt so as to support a free and open pool P of molten metal M. The metal M is introduced by means of a usually open-top runner Rn that is substantially smaller in cross section than the cross-sectional area of the casting region C between the casting belts. This is "open pool" feeding and is illustrated in FIG. 15. To permit easy pouring right in the pool P, the upper belt UB of an essentially horizontal straight caster is usually offset and made to converge toward the lower belt LB some distance downstream from where the lower belt leaves its upstream lower pulley ULP. This offset occurs when the upper carriage of such a machine is positioned a certain distance downstream. The offset may be varied. Open-pool pouring is to date the usual technique in the casting of copper or steel. Open-pool pouring is also used in the casting of lead, in which the problems of oxidation and cold shuts are not as serious as with aluminum.

The open-pool feeding arrangement (FIG. 15) is now used for continuous casting of metals of high melting point, such as copper and steel. An externally mounted telescopic optical sensor has been used to detect the visible or the infra-red radiation emanating from the free, open surface of the open metal pool within the mold; see U.S. Pat. No. 4,276,921 of Lemmens and Gielen, assigned to Metallurgie Hoboken-Overpelt of Belgium. The information from the optical sensor is used to control the rate of pouring so as to stabilize the open pool at the desired level.

However, the optical method is less appropriate in the casting of metals of lower melting point, such as lead, zinc, or perhaps aluminum, since the radiation is of diminished intensity, and oxide films may induce wide control-signal variations, notably with aluminum. Again, while the optical-sensing method works fairly well in the open-pool continuous casting of copper wire bar of 60×93 mm, the optical method becomes impractical for such casting of bar of narrow width, such as 50×58 mm copper bar, since the runner RN or spout which introduces the metal M into the mold area must occupy nearly all of the correspondingly narrow space at the entrance to the mold, thereby obstructing the optimum path of radiation to the externally mounted optical sensor. Moreover, smallish mold cavities that go with the casting of wire bar are more susceptible to internal reflections from edge-dam blocks, which reflections tend to confuse the sensing equipment. Careful aiming and adjustment of the normally employed zoom lens of the optical sensor may at times meet these problems. But the generally needed adjustments occurring from shift to shift have at times resulted in inconsistent casting machine operation.

A third problem applies to both the open-pool and closed-pool modes of pouring. In the earlier method of ascertaining the level of the pool of metal within the mold cavity by means of separately-indicating, multiple thermal probes, the indication of level was not contiuous but occurred in only a small number of discrete steps over the range of pool-height sensitivity. The probes responded with signals of essentially "yes" or "no". The number of steps corresponded to the necessarily limited number of thermal sensing probes, because the probes could, of necessity, be practically inserted only in particular locations due to the congested presence of other machine elements, notably backup rollers and water handling apparatus. The lack of a relatively continuous indication of pool level meant less information and less accurate level control when that multiple thermal probe apparatus was so used.

The belts of a twin-belt continuous metal casting machine are typically within the range of 0.025 to 0.078 of an inch (0.63 mm to 2 mm) in thickness, though the thickness is not necessarily confined to this range. Casting belts for wheel-and-belt casting machines, conventionally using only one casting belt, are apt to be appreciably thicker than this range includes.

SUMMARY OF THE DISCLOSURE

Pool-level sensing systems embodying the present invention overcome or significantly reduce the foregoing problems and provide several advantages over earlier equipment. Pool-level control employing the present invention has proved to permit fully automatic casting operation, and is evidently applicable to a wide variety of metals and alloys over a full range of melting points. We have discovered a method and apparatus whereby the use of even one properly placed thermal sensing probe positioned against the reverse side of a casting belt is not only feasible but also, with appropriate circuitry, the result of such use is enhanced control of molten-metal pool level as compared with a plurality of probes disposed serially from upstream to downstream and which were employed to give electrically separate signals for indication or control.

Unlike optical sensors, this new single-probe pool-monitoring system is suitable for use with either open-pool or closed-pool metal-pouring systems or apparatus. This new system is accurate enough to allow the use of but a single probe for a moving mold as wide as 36 inches (914 mm). In a straight twin-belt machine, the probe or probes are in either case normally placed against the reverse side or inside (also called the "cooled side") of the upper belt.

The heat of the molten metal does not instaneously traverse either the belt insulating coatings or the thickness of the thin flexible metallic belt, for the belt has thermal mass. Rather, the heat of the molten metal requires something less than half a second to stabilize the cooled side of the belt to about its peak temperature, which may vary from tepid to boiling.

During this brief interval, the casting belt in machines of typical proportions may move forward as much as two or three inches (51 or 76 mm) or more. Thus the moving belt presents toward the fast-flowing cooling water at any instant a continuous "ramp" R (FIG. 11) of ascending temperatures, as it appears on a graph having temperature plotted relative to a vertical axis and points along the belt plotted relative to a horizontal axis. A temperature of a certain number of degrees above the temperature of typical incoming cooling water is selected as the control point CP (FIG. 10); this control-point temperature should be intermediate between the extreme temperatures undergone by the belt on its reverse, water-cooled side. For example, this temperature control point CP (FIG. 10) is selected in the range from about 30° F. (17° C.) to about 60° F. (33° C.) above the flowing water temperature of about 67° F. (20° C.). The sensing probe is placed a short distance of about ½ to perhaps 3 inches (13 to 76 mm) downstream from the desired level-control point, at a place where the heating of the belt has proceeded perhaps half way toward its peak value.

In FIGS. 11A, B, and C, the upper surface of the molten pool P is indicated at S. When we describe the "level of the pool" or use a similar phrase, we are making reference to the elevation level of this upper surface S. The desired level-control point for this surface S during operation of the casting machine is pre-selected to be at LP in FIG. 11A. Then, a desired sensing point SP for sensing the temperature of the reverse face of the traveling casting belt is selected to be located a short distance Δx in the range from ½ to 3 inches downstream along the belt from the preselected desired level control point LP. This sensing point is selected with respect to the ramp R of temperature so as to be within the range from about 30° F. (17° C.) to about 60° F. (33° C.) above the incoming coolant temperature. This sensing point SP is at the point on the reverse face of the moving belt which has a temperature equal to the desired control-point temperature CP (please see also FIG. 10) on the ramp R of temperature (FIG. 11A), and said control-point temperature is preferred to be near the middle of the foregoing range of about 30° F. to about 60° F. above incoming coolant temperature. Incoming coolant temperature is usually near or not far above room temperature, namely, from about 67° F. (20° C.) to about 110° F. (43° C.). Then, the small sensitive area 102 of the thermal probe 48 (or the modified probe 62 in FIG. 9) is positioned at this selected sensing point SP.

If the pool surface S rises above the optimal level LP as shown in FIG. 11B, then the sensitive point 102 of the thermal probe 48 will experience a correspondingly greater temperature $T_1$ on the "ramp of temperature" R, because the ramp moves with the pool surface S; i.e., any point on the moving belt will have received heat longer by the time that such point gets to sensitive area 102 of the probe. If the pool surface S is falling, as shown in FIG. 11C, then the sensitive area 102 of the probe will become cooler at temperature $T_2$ on the "ramp of temperature" R.

Although we generally refer to this method as single-probe pool monitoring, there is sometimes an additional thermal sensor in the circuit: one in the probe against the casting belt, plus one immersed only in the incoming cooling water as a reference. The stability of the signal may thereby be improved, though this addition of water-temperature reference sensing is not usually necessary. The aforementioned thermal sensors could presumably be placed in series electrically speaking. In such a case, the output signals of the reference thermal sensor could be directly subtracted from the belt thermal sensor, in order to arrive at a temperature differential, this being some stable figure for control purposes. However, we prefer to feed these two sensor signals separately into a digital or analog electrical processor, that is, into a programmable controller, for signal comparison. In any case, the signal in its minute aspect may be either digital or analog. The output may be displayed for manual control of the rate of infeeding of molten metal into the casting machine or, alternatively, control of the rate of motion of the casting belts, by means of the variable-speed drive of the casting machine, since the belts conduct the frozen metal out of the machine. Alternatively, both modes of control may be utilized, the latter supplementing the former. Or again, even though a system embodying the present invention is utilized to control only the metal pour rate, such a system will enable quick and sure adjustments thereof. The need for quick and sure adjustments may arise from (1) mechanical disturbance through the frozen slab that emanates from the operation of a slab- or bar-cutting shear downstream, or from (2) automatically arranged changes in the casting machine speed that in turn arise from (2*a*) signals from mold-pressure load cells or from (2*b*) exit thermal sensors trained on the outcoming frozen slab. Either of these latter sensors report information that is indicative of the rate of freezing within the casting machine--information that in effect can be used to automatically request changes in the speed of the casting machine in order to optimize speed and productivity. Such load cells are disclosed and claimed in U.S. Pat. No. 4,367,783 of J. F. B. Wood et al, which is assigned to the same assignee as the present patent.

From another point of view, the main objective is to control the ratio of input to output of the metal being cast in the machine, and to control it optimally to a ratio of unity. In either way of looking at the overall operation and control of a twin-belt casting machine, the signals may be employed to control a servo device to establish a feedback control loop so as to automatically control the level of the open pool surface of molten metal.

The extent of pool level variation that can be controlled is increased by the use of multiple sensing probes, connected effectively in series and disposed in closely spaced position along the direction of motion of the moving mold. These multiple probes afford a greater physical length of effective pool-level monitoring and hence control than is possible with a single probe. Such a multi-probe setup minimizes the necessity of occasional manual control in order to bring the pool level into the range of automatic control. At the same time, if multiple probes are employed in a control system embodying the present invention, only a single-channel signal results, thereby providing the same ramp-like indication, in contrast to earlier apparatus which monitored a multiplicity of points and indicated them separately as signals of merely "yes" or "no".

All the sensing probes which contact one belt may in effect be wired in series or in any case may be related in such a way that their signals effectively are processed or computed instantaneously into one output signal. Where this plan is utilized, the output of each of a plurality of thermocouples or other sensors is typically fed separately into an electronic processor, where the output due to each probe is computed or processed, mainly as a matter of cumulation or addition, or order to yield a single-channel, unitary reading. They are spaced at a generally uniform longitudinal spacing A or A′ of about ½ inch to about 4½ inches to cover a total length of anything to about 9 inches (229 mm), depending on conditions (see FIG. 12). As with a single probe, the higher the pool level, the greater the reading or value of this single-channel cumulative electrical response. But when employing the multiple probes in the utilization of this method, the range of response is greater than when utilizing just one probe--both electrically and as to the range of possible pool levels covered. As before, the signals from this arrangement can be fed into a feedback circuit acting as a control loop to automatically control the rate of flow of molten metal from the tundish T in FIG. 13 and 14, or even to control the flow farther upstream in a tilting holding furnace, for example.

Injection-fed installations as illustrated in FIG. 13 are commonly presupposed to run with the moving mold full of metal and hence instrumentation to determine the level of the metal is commonly regarded as unnecessary. However, under conditions of injection feeding, the mold is not visible, and with some alloys, when the mold does not run full, metallurgical problems may result in the product. When the mold is underfilled, one cause is apt to be that one or more passages for the feeding of molten metal through the nosepiece have become clogged with foreign matter, such as aluminum oxide in the case of aluminum casting. A thermal sensing probe at or near the beginning of the mold, notably against the top belt, can detect a gaseous void G forming in the mold (FIGS. 14 and 14A) as the result of nozzle clogging and thus alert the operator to "rod out" the foreign matter from the nosepiece passages and so to refill the void. This rod-out nozzle-unplugging procedure is feasible during the casting of aluminum, notably, if it is done during an intermediate, unused length of cast that falls between two portions of the casting that will be rolled to form two successive coils of finished sheet metal or bar. The thermal sensing probe so used will generally be within 6 inches of the exit end of the snout.

BRIEF DESCRIPTION OF THE DRAWINGS

FIG. 2 is a view as seen along the irregular line 2—2 in FIG. 3.

FIG. 4 is a perspective view, shown partially in section, of a thermal sensing probe with streamlined shoe or skate. Some of the mounting parts are omitted in this view.

FIG. 5 shows the components of the thermal sensing probe of FIG. 6 in an exploded view.

DETAILED DESCRIPTION OF THE PREFERRED EMBODIMENTS

Figure 1:
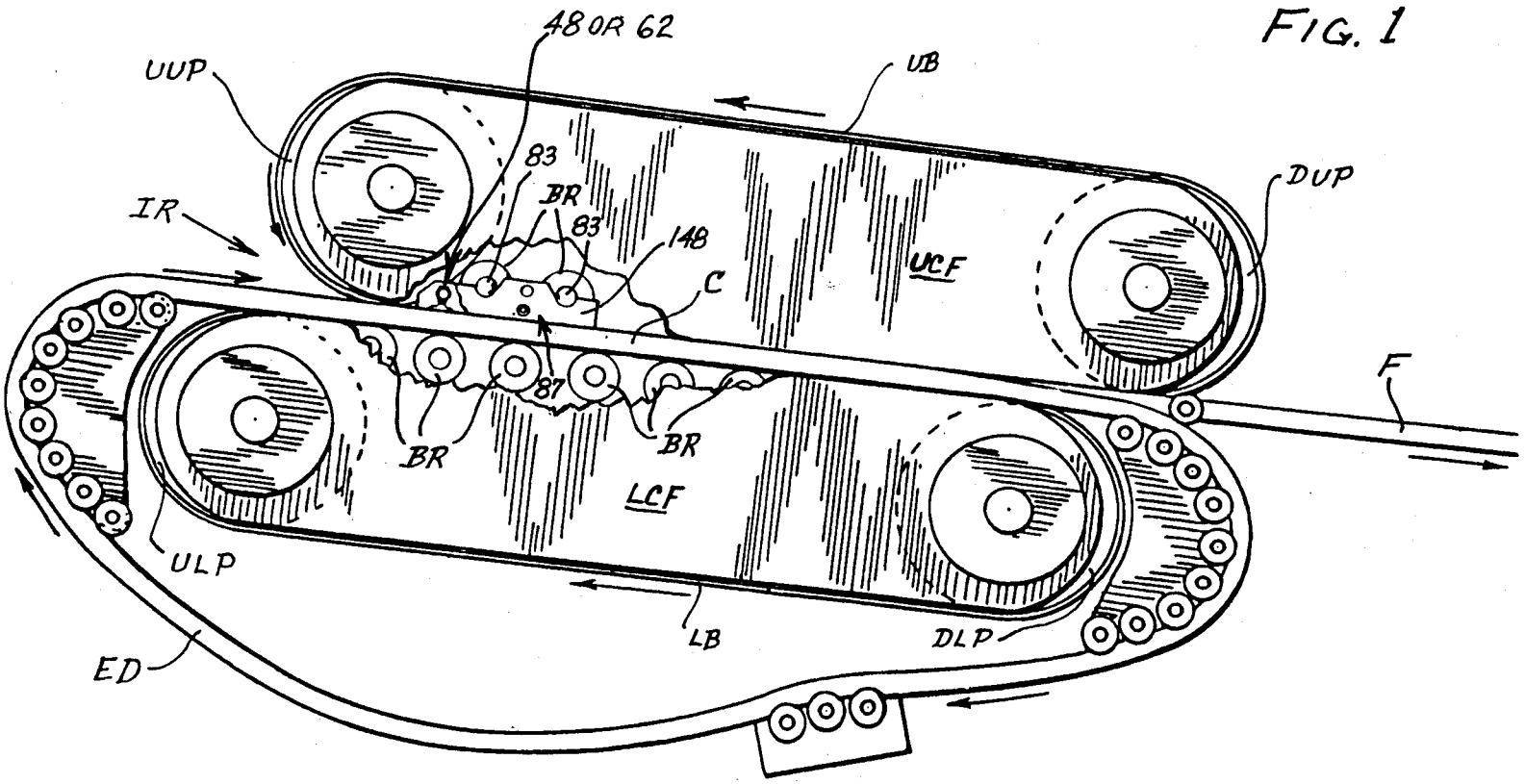
FIG. 1 is an elevation view of a continuous casting machine in which the present invention may be used. In this drawing, the machine is shown with staggered backup rollers, shown in cutaway areas.
Figure 2:
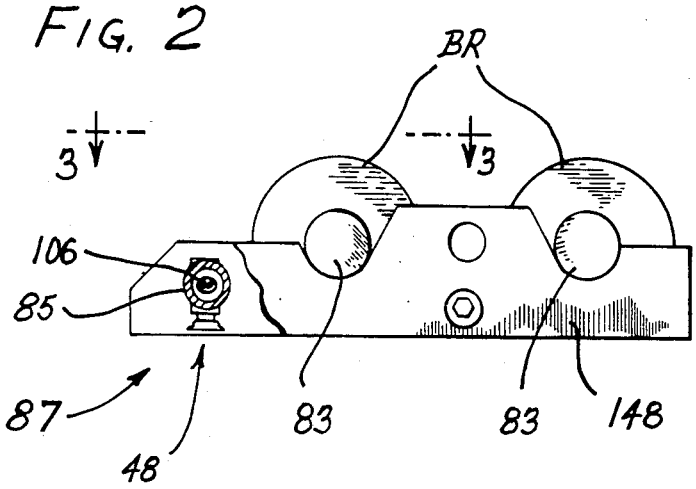
FIG. 2 is a cutaway enlarged detail of a portion of FIG. 1, revealing a single thermal sensing probe and its locale near the inside (upper) surface of the upper casting belt.
Figure 6:
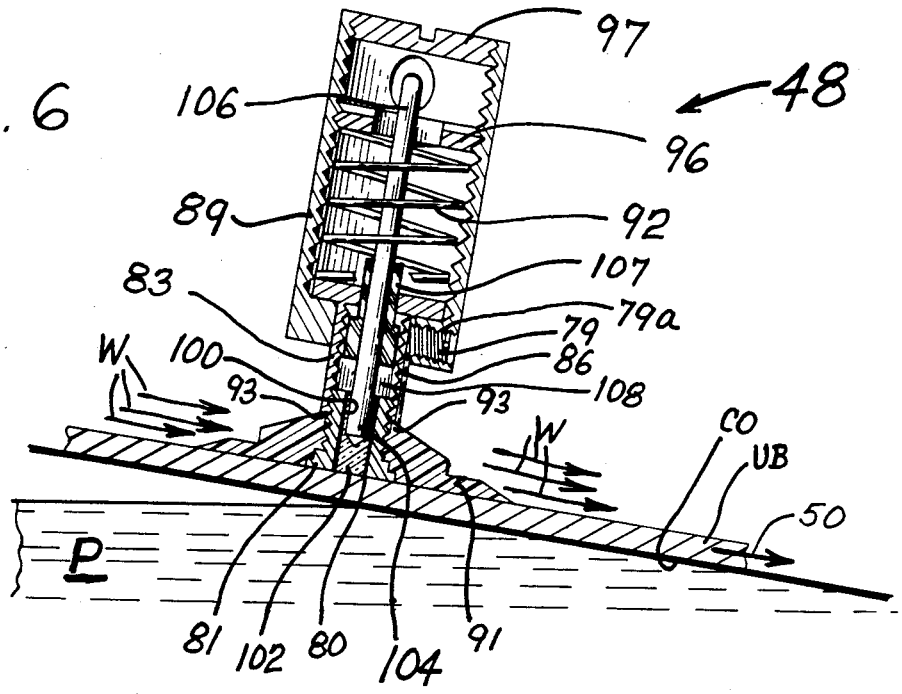
FIG. 6 is a sectioned elevation of the thermal sensing probe of FIG. 5.
Figure 11:
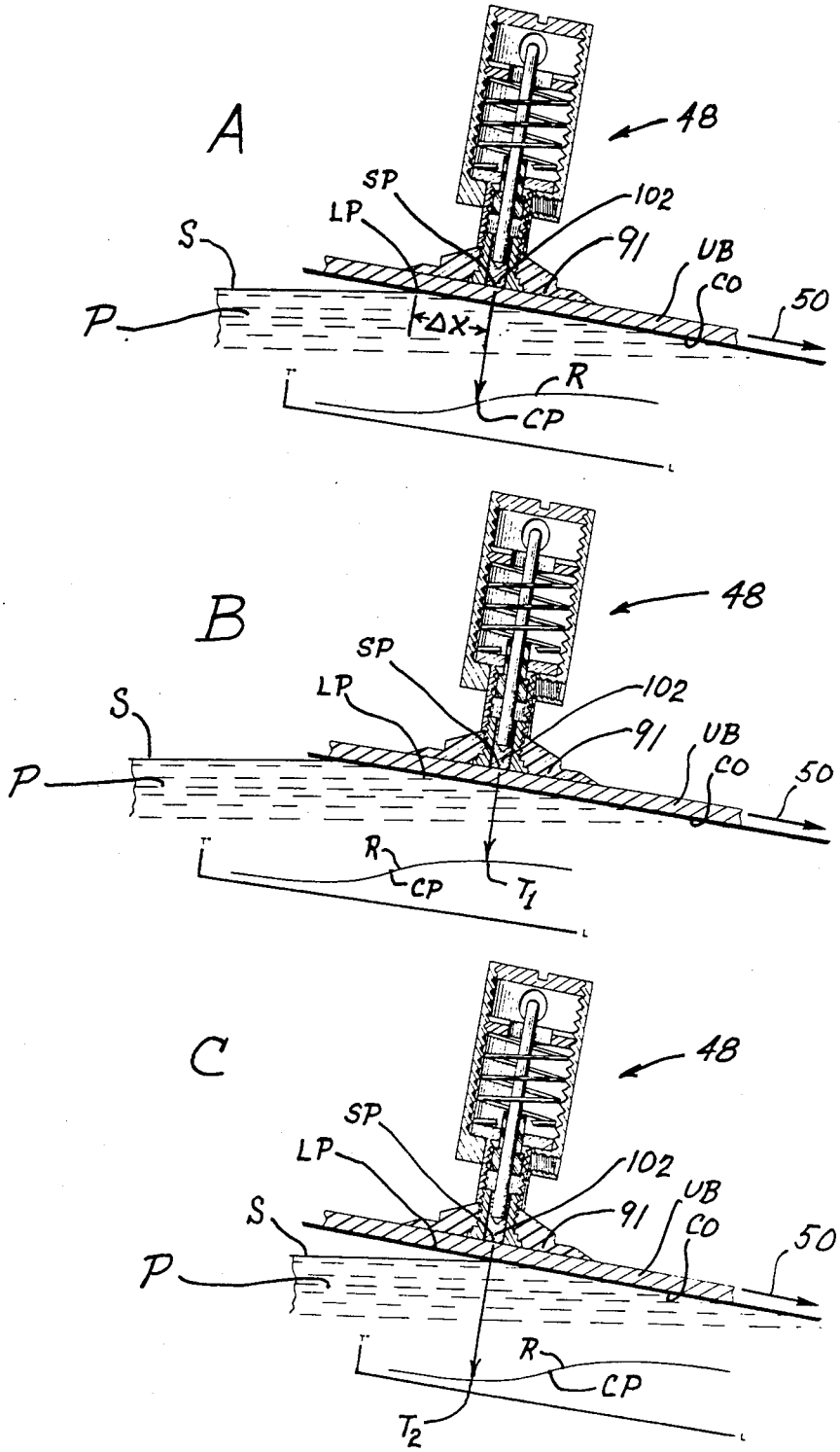
FIG. 11A is a view similar to FIG. 6, with the molten metal pool shown at the normal level, and with a graph of the temperature of the reverse (upper-surface) side of the casting belt at any instant during casting, corresponding to points along the casting belt.
FIG. 11B is a view similar to FIG. 11A but with the pool elevated above the norm, with a corresponding thermal graph of the "ramp of temperature" as in FIG. 11A. It is to be noted that the "ramp" in FIG. 11B is shifted to the left as compared to FIG. 11A.
FIG. 11C is a view similar to FIG. 11A, but with the pool below the norm, with a corresponding thermal graph of the "ramp of temperature" as in FIG. 11a. It is to be noted that the "ramp" in FIG. 11C is shifted to the right as compared with FIG. 11A.
Figure 13:
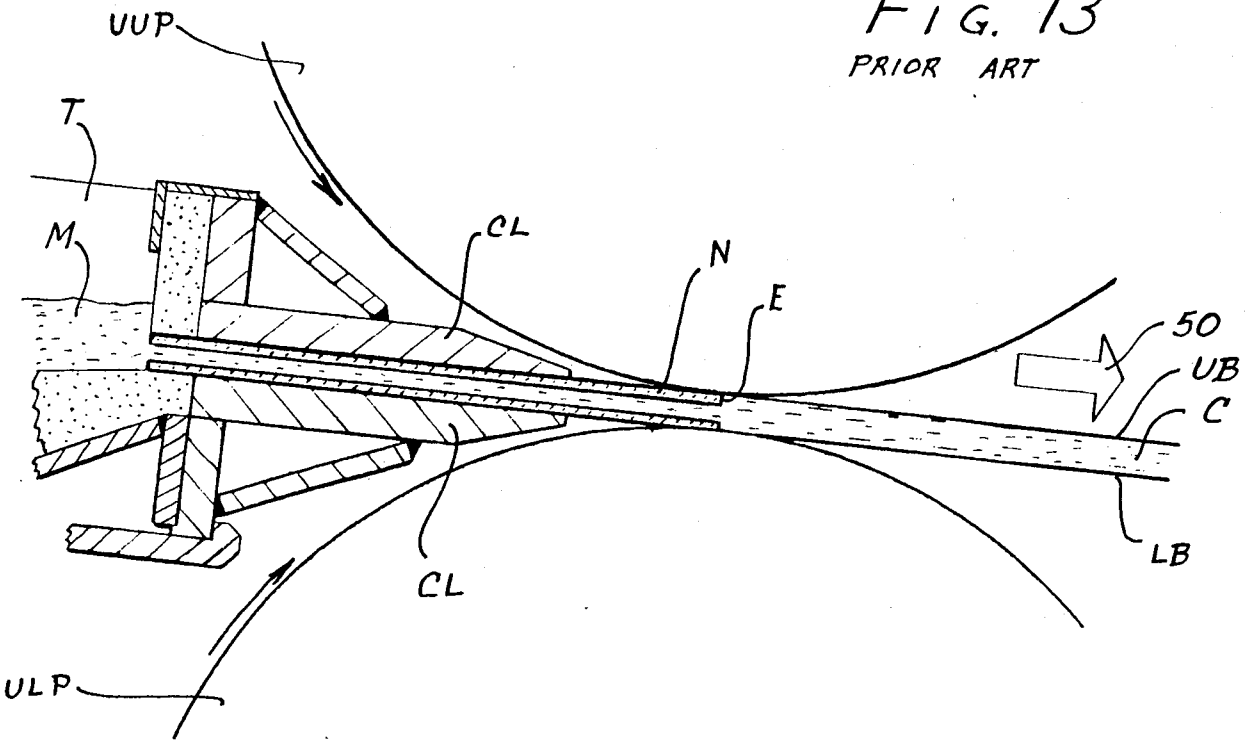
FIG. 13 PRIOR ART
FIG. 13 shows injection feeding, in a sectioned elevation view, omitting any thermal sensing probe.
Figures 14, 14A:
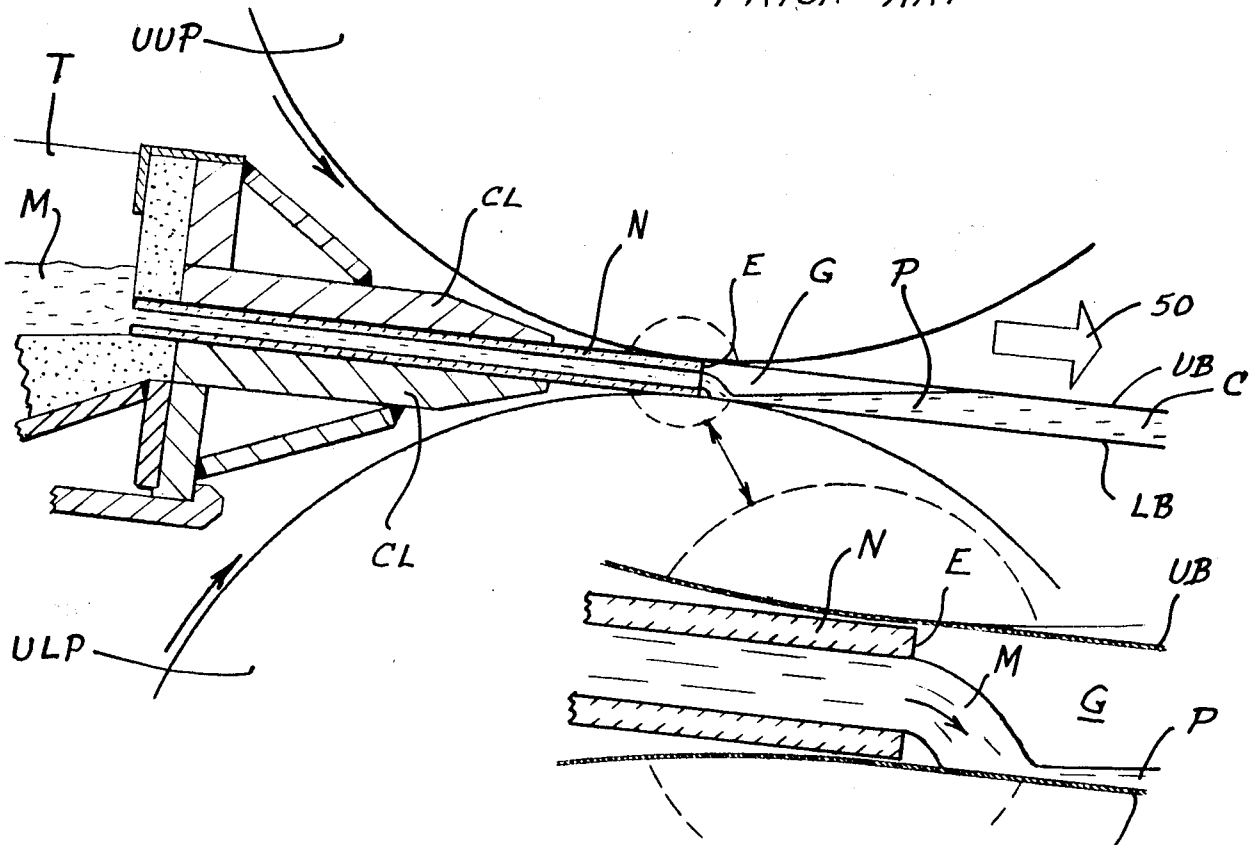
FIG. 14 PRIOR ART
FIG. 14 shows closed-pool feeding, in a sectioned elevation view, omitting any thermal sensing probe.
FIG. 14A is an enlargement of the portion of FIG. 14 which is indicated by the dashed-line circle in FIG. 14, omitting any thermal sensing probe.
Figure 15:
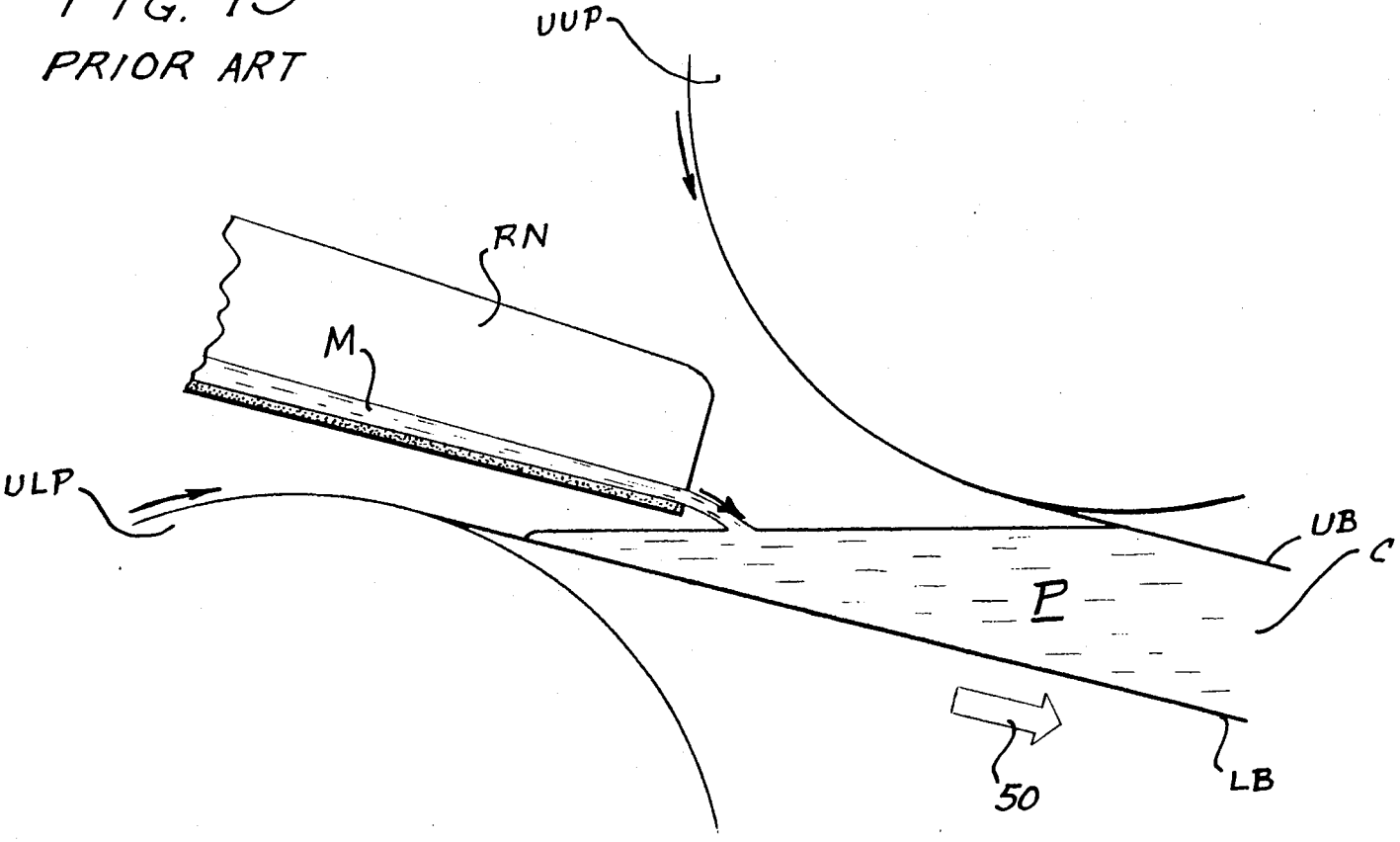
FIG. 15 PRIOR ART
FIG. 15 shows open-pool feeding, in a sectioned elevation view, omitting any thermal sensing probe.

Continuous twin-belt casting machines similar to those shown in FIG. 1 have been described in the previous, referenced patents. Briefly, the upper belt is designated UB and the lower belt LB, which bear coating CO as indicated in FIGS. 6 and 11. The directions of motion are shown by arrows. The upstream pulleys are designated UUP and ULP (upper and lower)—the downstream pulleys DUP and DLP. The tundish T (FIGS. 13 and 14) containing the molten metal M cooperates with clamps CL which clamp the metal-feeding nosepiece or snout N (or an open runner RN in FIG. 15). The casting region is C (FIG. 1), the molten metal pool is P (FIGS. 14 and 15), and the emerging frozen product is F (FIG. 1). The direction of movement of the frozen product F and typically of the liquid coolant W (FIG. 6) is shown by arrows, which direction is designated *downstream*. The backup rollers are BR, and the moving edge dams are ED.

The thermal sensing probe or detector 48 or 62 is made as shown in FIGS. 4 through 9. Some of the elements correspond with those in U.S. Pat. Nos. 3,864,973 and 3,921,697, which are incorporated herein by reference. The same reference numbers are used in this specification as were used in those patents to designate corresponding elements of the probe where applicable.

Figure 7:
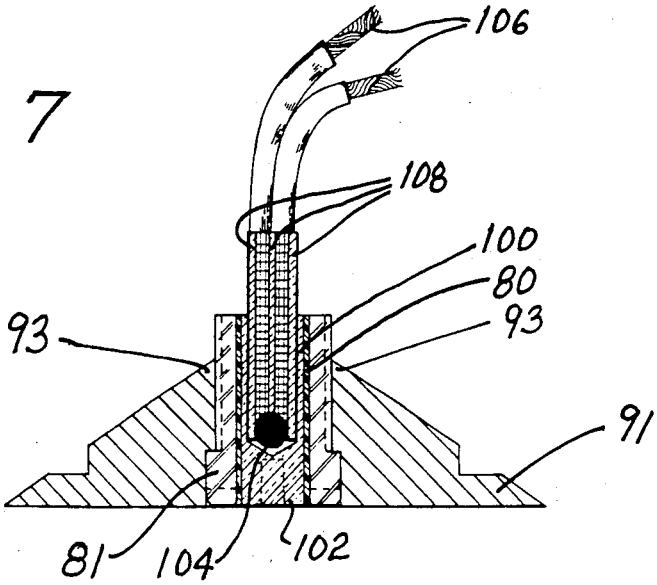
FIG. 7 is an enlargement of the tip portion of the thermal sensing probe of FIG. 6, shown in section.
Figure 8:
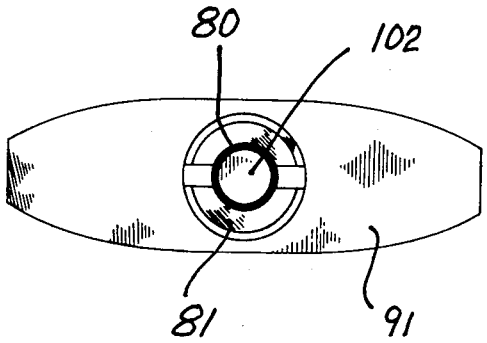
FIG. 8 is the thermal sensing probe as seen from the lower side which contacts the casting belt.

A type E (chromel-constantan) thermocouple 104 (FIGS. 5, 6, and 7) is the preferred sensing element. Other thermocouple pairs may be used. Alternatively, a small thermistor may be used, with appropriately altered input circuitry in the electronic processor. A contact sleeve 100 (FIG. 7) of highly heat-conductive material such as copper encompasses the thermocouple junction 104. This conductive sleeve 100 has a closed end 102 (FIG. 7), which is intended to touch the casting belt UB, as shown in FIG. 6. The thermocouple 104 and the sleeve 100 are secured together with a potting compound such as epoxy plastic resin 108 (FIG. 7). Wires 106 protrude from the thermocouple, kept in position by a soft plastic bushing 107. A sleeve 80 (FIG. 7) of ordinary heat-shrink tubing is shrunk over the copper contact sleeve 100. This heat-shrink plastic tubing 80 provides thermal insulation from the flowing water W; it also provides electrical insulation. This assembly is then pressed into a hollow cap screw 81 (FIG. 5), such that the end 102 of the copper sleeve 100 is flush with the cap of the cap screw 81, as shown in FIG. 7. The cap screw 81 may be of stainless steel. Its cap diameter is about 0.25 inch or 6 mm.

The entire foregoing assembly with cap screw 81 is then screwed into the end of cylindrical sleeve 83 (FIG. 5), which may be of brass. At the same time, a protective streamlined wear shoe or skate 91 of an extra hard substance is secured to the brass sleeve 83 by cap screw 81, as seen in FIG. 7. A carbide such as tungsten carbide, or hardened stainless steel such as full-hardened 440C, may be used for the skate 91, in order to endure for a sufficient period of continuous sliding against the reverse side of the casting belt UB, for protecting the closed end 102 of the copper sleeve 100 meanwhile against too rapid wear. As shown most clearly in FIG. 7, the face of the protective wear shoe 91 is flush with the closed end 102 of the copper sleeve 100. The shoe 91 is streamlined to minimize the disturbance to the fast water flow but must be kept aligned with the direction of the rushing flow of water W (FIG. 6). The velocity of the fast water flow W (FIG. 6) is orders of magnitude faster than the rate of travel of the casting belt UB, as shown by the downstream casting travel arrow 50 (FIG. 6). To this end, a milled longitudinal slot 86 (FIG. 5) in the side of the brass sleeve 83 is engaged by setscrew 79. The setscrew 79 is however not tightened against the slot 86 but is secured in a hole 79a with anerobic-setting metal cement in a slightly aloof position such that the sliding of the brass sleeve 83, with all its attached parts within stationary stainless-steel housing 89, is permitted but rotation is blocked.

To the end that the wear shoe 91 is kept aligned with the flow of water W, the shoe itself contains a pair of integral keys 93 (FIGS. 4 and 5), which engage corresponding notches 95 (FIG. 5) in the brass sleeve 83. The sliding of the brass sleeve 83 occurs under the impetus of spring 92. The spring force ultimately presses the closed end 102 of the sleeve 100, together with the protective wear shoe 91, against the casting belt UB. The spring is contained by a short slotted hollow screw 96 (FIG. 5). The cavity of housing 89 is capped with short cap screw 97. The slot 86 and the setscrew 79 limit the travel of the brass sleeve 83, so that the assembly is kept together when a casting belt UB is not in place or not taut.

Figure 3:
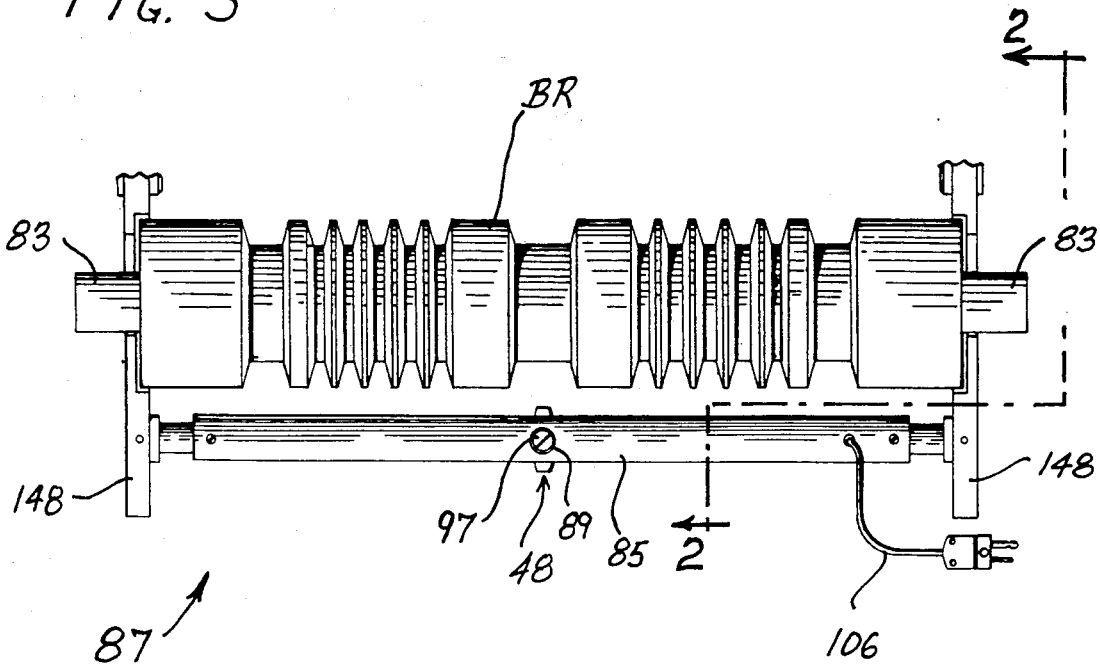
FIG. 3 is a partial plan view, as seen from 3—3 in FIG. 2, showing especially the mounting means for a rigidly mounted thermal sensing probe. The illustrated backup roller as shown is for a machine to cast narrow bar.

The mechanical support housing 89 must be held rigid and true, since misalignment will result in poor contact and unreliable readings. The support housing 89 is itself part of a mainly tubular support assembly 87 as is shown most clearly in FIG. 3. In it, the stationary housing 89, which contains the thermal sensing probe 48, is welded to a transverse tube 85. Besides affording mechanical support, this tube structure 85 protects the thermocouple wires 106, which go to the electronic processor. The transverse tube 85 and associated parts are themselves located with respect to the casting machine by means of yokes 148, which hook over stubs 83 which secure backup rollers BR and are further secured by screws to the upper carriage frame UCF (FIG. 1) of the casting machine. There is also a lower carriage frame LCF of the casting machine.

Figure 16:
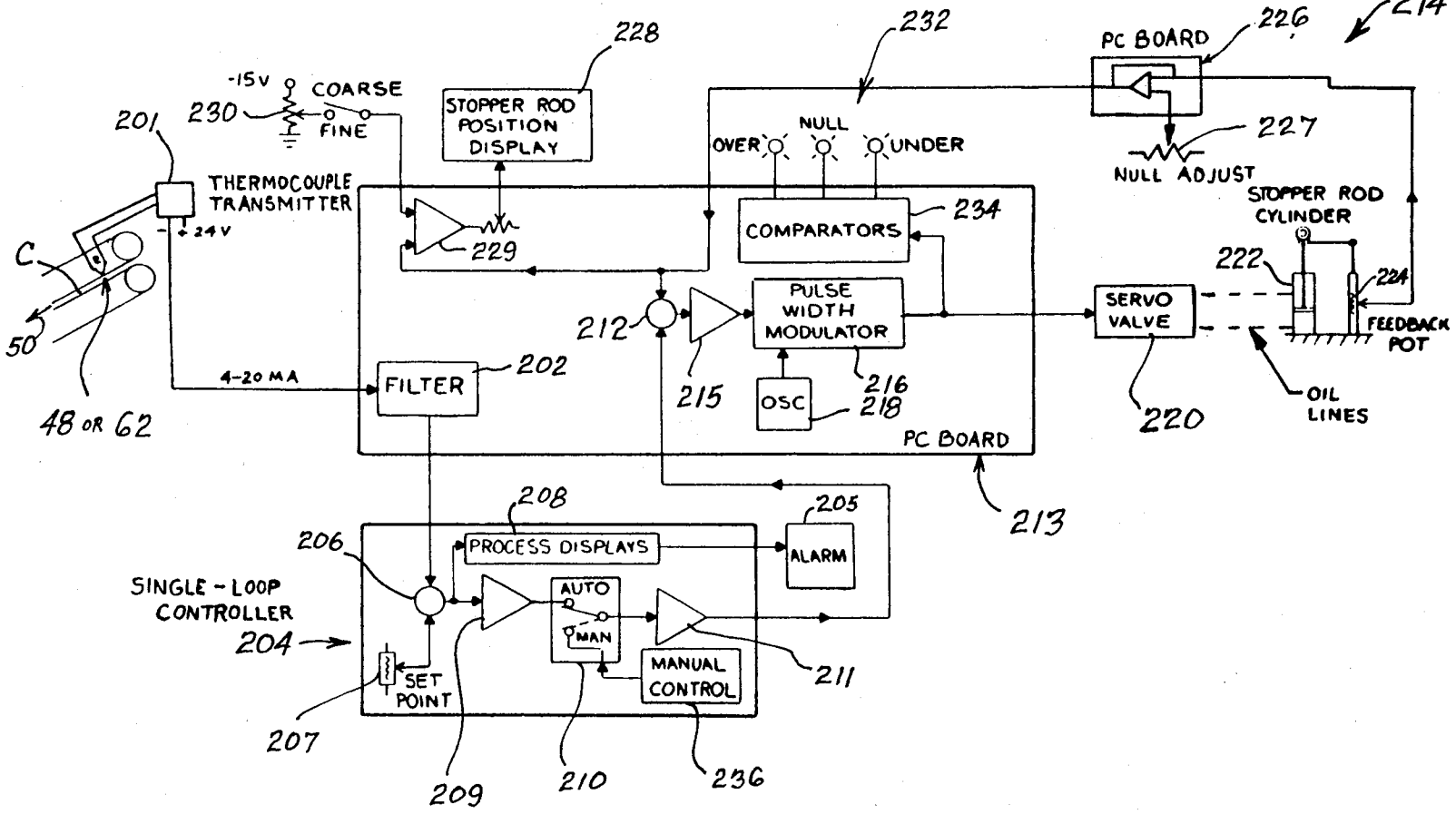
FIG. 16 is a schematic drawing of the electrical-control arrangement for a single-probe system in automatic operation.

The electronic process controller with a circuit designed for automatic operation is shown schematically in FIG. 16 as set up for only one thermal sensor or probe 48 or 62 that bears or skates against the casting belt. The components and electrical quantities mentioned below are illustrative examples of one successful installation. The signal from the thermal sensor 48 is a weak DC signal of millivolts and microamperes. This weak signal goes to a thermocouple transmitter 201. The transmitter 201 amplifies and transforms he weak signal (or signals if more than one sensor) to an amperage varying from 4 to 20 milliamperes. The resulting signal from the transmitter 201 is a single-channel signal (it is a combined unitary output signal of the thermal sensors, when there is more than one sensor).

Figure 10:
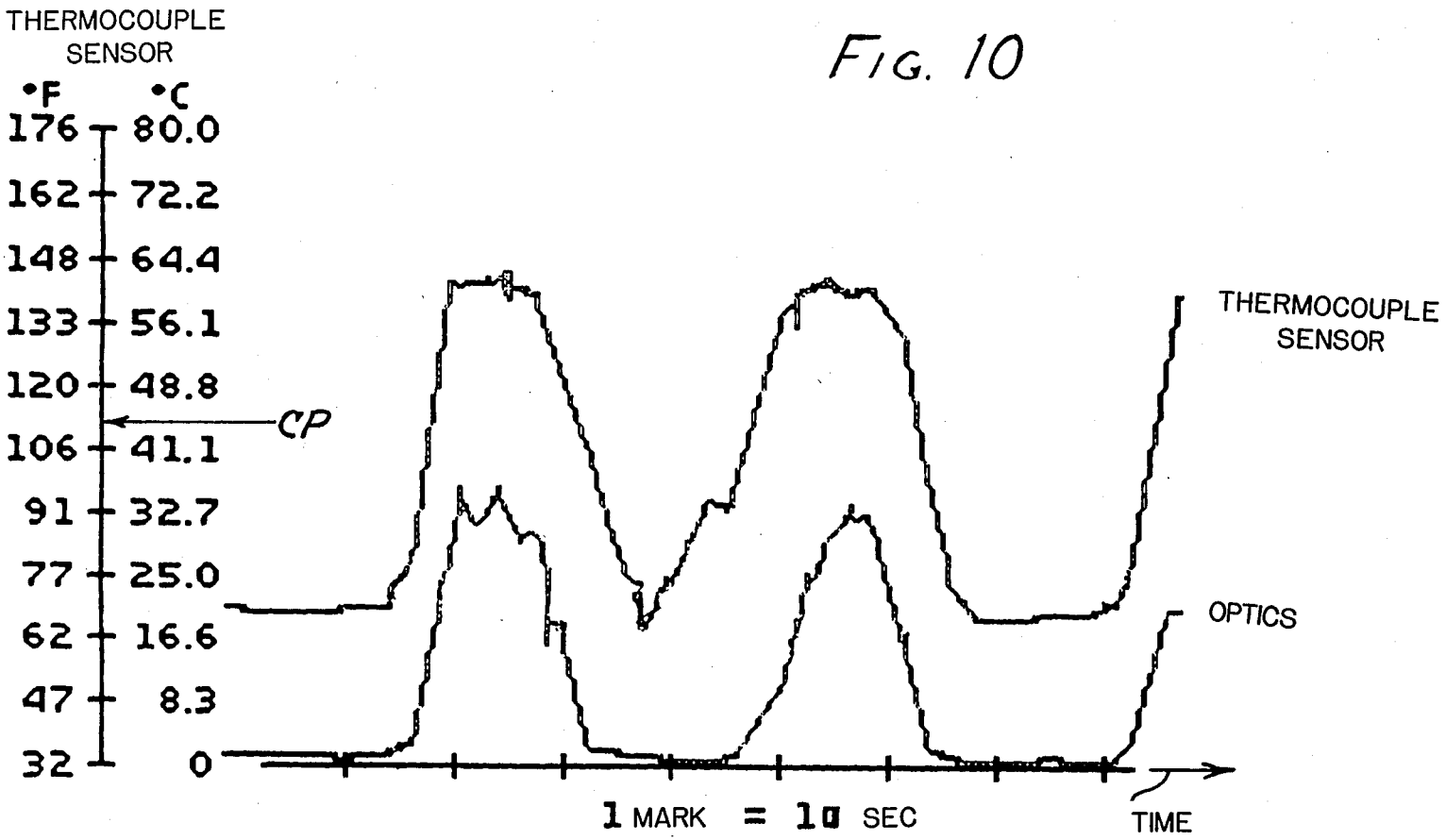
FIG. 10 is a simultaneous moving-chart recording of the thermally calibrated output of the single thermal sensing probe, as compared to the uncalibrated output of an optical sensor, for which the vertical temperature scale does not apply.

Then, the single-channel signal enters filter 202, whence it emerges as a signal of up to 10 millivolts. Then, the filtered signal enters the digital single-loop controller indicated generally at 204, which may be Leeds & Northrup Electromax 5+. The signal first goes to the comparator point 206 where an adjustable "set point" voltage from potentiometer (or digital reference point) 207 is subtracted, in order to establish the desired set-point CP (FIGS. 10 and 11) for pool level control. The resulting output is displayed as 208. This output is also amplified at 209 and put through an automatic/-manual switch 210. An alarm signal device 205—example, a light plus a bell-is associated with the process display 208 for giving an alarm warning when the thermal sensor 48 or 62 happens to transmit a signal indicating a temperature being sensed which is above or below the predetermined maximum and minimum values preselected in relation to the desired selected control point CP (FIG. 10) and relating to the ramp of temperature R (FIG. 11).

When the switch 210 is put in the "auto" position for automatic control, the signal goes through another amplifier 211 and is fed at a level of 0 to 20 mA to the main printed-circuit (PC) board 213 and to another comparator points 212, which is included in the internal feedback control loop 214, where the position of the stopper rod (not shown) which controls the flow of molten metal is taken into account as will be explained later. (Or some other metal flow control device may be employed, for example, a tilting tundish.) Before this loop control signal reaches the stopper rod servo valve 220, it is amplified at 215 and put into the form of square-wave pulses of frequency 30 Hertz and of amplitude 1.5 to 15 ma. This forming of square-wave pulses is done by means of a 30 Hz sawtooth oscillator 218, which sawtooth pulses are clipped approximately square and then polarized positively or negatively according to whether the incoming signal is positive or negative. Or the modulator 216 will block the clipped pulses if the incoming signal is about null. The new square-wave pulse which emerges represents with great rapidity the instantaneous fluctuations received from the thermal sensor 48 or 62. This final signal is also in a form suitable to the fast-acting, fluttering servo valve 220, which operates the stopper-rod hydraulic cylinder 222, thereby controlling the rate of flow of molten metal. Feedback of the position of cylinder 222, representative of the stopper-rod position, comes from a linear, sliding, conductive plastic potentiometer 224. Its signal goes through an adjustment at process control station 226, where a null adjusting potentiometer 227 is used to establish at commissioning the preferred steady-state set-point for the location of the stopper rod 224. The modified signal from flow-control set-point station 226 is fed to the comparator 212 to be compared with the pool-level indication that originated at thermal sensor 48 or 62. That comparison at 212 completes the internal feedback control loop 214, and at the same time completes the external feedback control loop involving molten metal and mechanical hardware, so that automatic control of metal level is achieved. Further, the feedback signal of stopper-rod metal flow control position from potentiometer 224 as modified at 226 is amplified at 229 and displayed at 228, on a vertical bar scale consisting of a mutliplicity of vertically stacked light-emitting diodes.

The hydraulic-power components, notably servo valve 220 and hydraulic cylinder 222, may be replaced by electrical components—for example, an electric stepping motor and its control circuit, which together operate the stopper rod.

Coarse-fine circuit 230 will, when switched to "fine," magnify a section of the bar-scale display 228 to obtain a very sensitive readout of the position of stopper-rod 224. All electrical and electronic controls are advantageously centralized at one location for the purpose, for instance, of facilitating and synchronizing the automation of a casting and rolling line.

A visual display at 232, actuated by comparators 234, includes three light signals for showing to the operator the current operating condition of the metal control system, namely, whether the system is at the desired "null," or whether is "over" or "under" the desired null set point.

Certain manual bypass procedures are available in case of circuit failure. If the control loop fails, but with the servo valve 220 remaining operable, the digital single-loop controller 204 can be switched to manual servo control 236 by means of the switch 210. If the electricity or the servo valves 220 have failed, then direct manual hydraulic operation of the stopper rod cylinder 222 may be carried out.

Apparatus similar to the electronic and hydraulic control equipment just described apply also to the feeding of molten metal into the tundish T that in turn feeds metal to the casting machine, as in the control of a tilting holding furnace.

Figure 9:
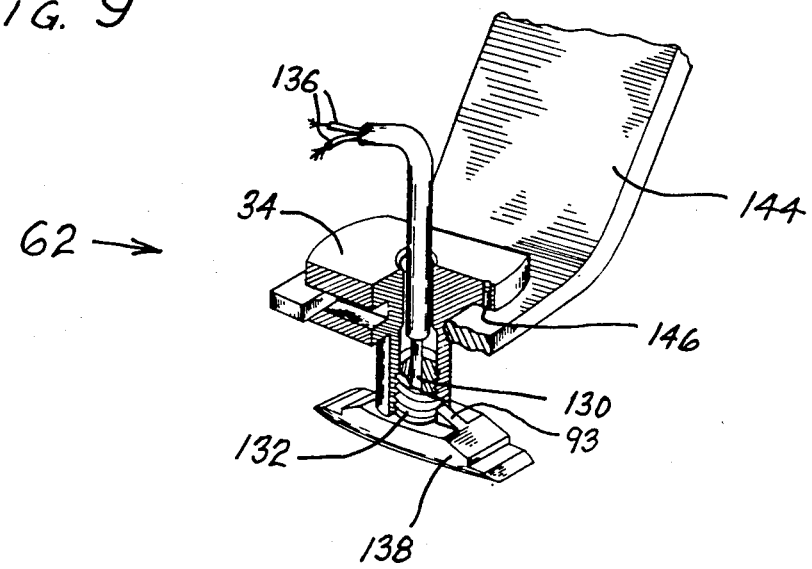
FIG. 9 is a perspective view, shown partially in section, of a disposable thermal sensing probe, mounted on a cantilever spring strap.

Instead of the described construction of incorporating a compression spring and plunger into the probe, an optional modification 62 (FIG. 9) now under study is to mount a simpler thermal sensing probe ona cantilever beam spring, as shown in FIG. 9. Such an assembly 62 may be discarded when worn out. The base 34 holds the insert 132, to which is firmly fastened the extra hard shoe or skate 138. This shoe may be advantageously made from a small reversible tungsten carbide tool bit, with the protruding sides ground slightly for streamlining in the direction of water flow. The thermocouple 130 terminates the lead wires 136. The whole "throwaway probe" is mounted on a cantilever metal spring 144 and removably secured with a pin 146. An advantage of the throwaway probe is that frequent inspection is not so necessary; in this respect, this modification shown in FIG. 9 is unlike the probe described above with its plunger 83 which, if allowed to wear too far, must be replaced, plunger mechanism and all.

Figure 12:
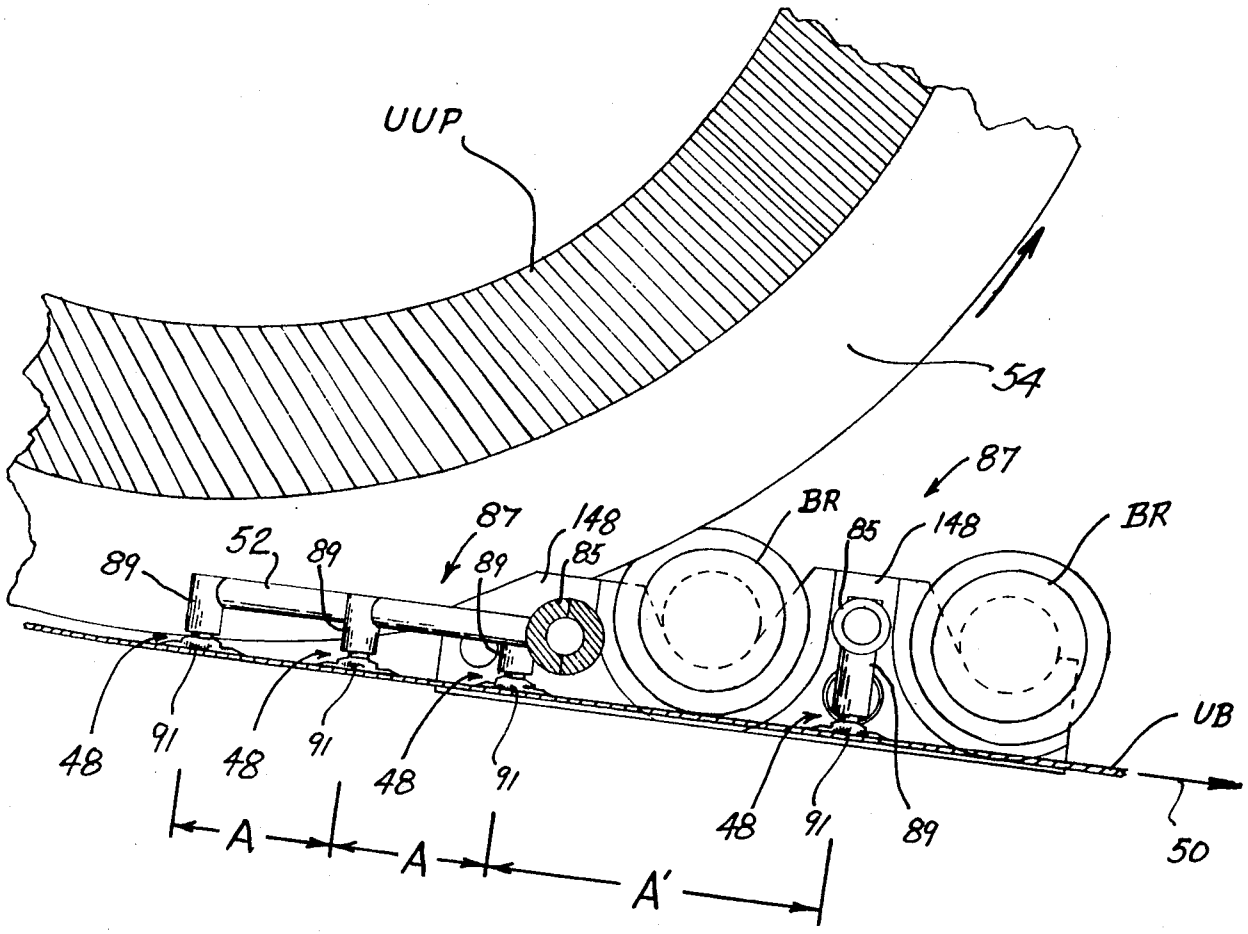
FIG. 12 shows the same apparatus as FIGS. 1 and 2, except that there are four sensing probes disposed longitudinally at generally uniform spacing and extending upstream into a groove in the pulley. The probes are treated electrically as though they were wired in series.

In the modified embodiment shown in FIG. 12, there are four thermal sensing probes 48 having their shoes 91 in sliding contact with the reverse surface of the upper belt UB. One of these sensors 48 is located between the first two backup rollers BR for the upper belt. The other three sensors 48 have their housings 89 secured to a support arm 52 projecting in an upstream direction from a transverse support tube 85 attached at each end to a yoke 148. The support arm 52 extends into a circumferential groove 54 in the upstream upper pulley UUP.

RESULTS

Copper rod of 60×93 mm cross-section for in-line successive rolling to 8 mm wire-drawing rod has been cast with automatic level control. In this work, a thermal sensing probe ran at an average peak temperature of about 142° F. (61° C.). The incoming water temperature was about 67° F. (20° C.), which represented a temperature difference ΔT of about 75° F. (42° C.) The speed was 40 feet per minute (13 meters per minute). The pool of molten copper oscillated up and down during the control, over a maximum upstream-to-downstream range of about two inches (51 mm) as measured along the belts, which were inclined at an angle of 15 degrees down from the horizontal; hence, the vertical oscillation of the pool was within the acceptable range of about 0.5 inch (13 mm). The control-point temperature CP was set not far from 112° F. (44° C.).

In the above-described copper cast, the outputs of the thermal sensing probe and the optical sensor were recorded simultaneously. Each tick mark along the horizontal time line at the bottom of the plot indicates an interval of ten seconds. A typical portion of the record is displayed in FIG. 10. The thermal record of the thermocouple sensor 48 or 62 is calibrated and plotted according to the temperature values shown along the vertical line at left. The optical sensor record is plotted at the same relative scale of size as the thermocouple record for purposes of comparision, but is not calibrated with respect to temperature marks on the vertical scale. The record of the optics sensor may be regarded as relatively accurate for present purposes. The two records will be seen to correlate closely, thereby illustrating the usefulness of the thermal sensing probe, especially in instances where the optical probe cannot be used.

In the production of aluminum slab for in-line rolling, completly uninterrupted automatic production of over four days and nights has been achieved by a control system embodying the present invention. In the casting of aluminum, the probe temperature has been measured as high as 113° F. (45° C.) as compared to an incoming water temperature of 67° F. (20° C.), for a differential ΔT as high as 46° F. (25° C.). Hard shoes or skates of the thermal probes of the present design as described utilizing hardened stainless steel shoes have lasted more than a month in nearly continuous duty.

Although the examples and observations to date have involved a limited number of molten metals and alloys, this invention appears to be applicable to virtually all metals and alloys which can be continuously cast.

Although specific presently preferred embodiments of the invention have been disclosed herein in detail, it is to be understood that these examples of the invention have been described for purposes of illustration. This disclosure is not to be construed as limiting the scope of the invention, since the desired methods and apparatus may be changed in details by those skilled in the art, in order to adapt these apparatus and methods of sensing, monitoring, and controlling molten metal level to be useful in particular casting machines or situations, without departing from the scope of the following claims.

We claim:

1. In a continuous metal-casting machine having an input region for introducing molten metal into a pool P of molten metal having an upper surface S and wherein flow-control means control the rate of introducing molten metal into said pool, said casting machine employing at least one moving flexible casting belt having a front face for contact with the molten metal in said pool and a reverse face which is cooled by aqueous coolant having an incoming temperature and wherein said casting belt travels downstream in the machine at a controllable travel rate for carrying metal downstream from said pool to become solidified and wherein the temperature of each point on the reverse face of the traveling belt rises from an initial temperature prior to contact with the molten metal to a steady state temperature after remaining in contact with the molten metal, said rise in temperature of each such point occurring along a ramp R of ascending temperature as each opposite point on the front face travels downstream from initial contact with the molten pool surface S, and wherein the physical position of said ramp R of ascending temperature moves upstream and downstream as said pool surface moves upstream and downstream, the method for controlling the elevation level of said pool surface S as the casting machine is operating comprising the steps of:

selecting a desired elevation-level control-point LP for said molten pool surface S during operation of the casting machine, selecting a sensing point SP for sensing the temperature of the reverse face of the traveling belt to be a small distance Δx in the downstream direction from said desired level-control point LP, said small distance being predetermined to be at a control-point temperature CP within a predetermined range of temperature ΔT on said ramp R of ascending temperature, positioning the sensitive area of a signal-producing thermal probe against the reverse face of the traveling belt at said selected sensing point SP for causing the thermal probe to provide a signal increasing in value as said ramp R of ascending temperature moves upstream and decreasing in value as said ramp R of ascending temperature moves downstream, and using the value of the signal from said thermal probe for controlling said flow control means for controlling the rate of flow of molten metal into said pool for controlling the elevation level of said pool surface S to be near said selected elevation level control point LP.

2. In a continuous metal-casting machine having an input region for introducing molten metal into a pool P of molten metal having an upper surface S, said casting machine employing at least one moving flexible casting belt having a front face for contact with the molten metal in said pool and a reverse face which is cooled by aqueous coolant having an incoming temperature and wherein said belt travels downstream in the machine for carrying metal downstream at a variably adjustable speed of motion from said pool to become solidified, and wherein the temperature of each point on the reverse face of the traveling belt rises along a ramp R of ascending temperature rising from an initial temperature prior to contact with the molten metal to a steady state temperature after remaining in contact with the molten metal, said rise in temperature of each such point occurring as each opposite point on the front face travels downstream from initial contact with the molten pool surface S, and wherein the physical position of said ramp R of ascending temperature moves upstream and downstream as said pool surface moves upstream and downstream, the method for controlling the elevation level of said pool surface S as the casting machine is operating comprising the steps of:

selecting a desired elevation-level control point LP for said molten pool surface S during operation of the casting machine, seleting a sensing point SP for sensing the temperature of the reverse face of the traveling belt to be a small distance Δx in the downstream direction from said desired level-control point LP, said small distance being predetermined to be at a control-point temperature CP within a predetermined range of temperature ΔT on said ramp R of ascending temperature, positioning the sensitive area of a signal-producing thermal probe against the reverse face of the traveling belt at said selected sensing point SP for causing the signal produced by said thermal probe to indicate the physical position of said ramp R of ascending temperature, and using the signal from said thermal probe for controlling said variably adjustable speed of motion for controlling the rate of carrying metal downstream from said pool, for controlling the elevation level of said pool surface S to be near said selected elevation level control point LP.

3. In a continuous metal-casting machine, the method for controlling the elevation level of said molten pool surface S as claimed in claims 1 or 2, in which:

Δx is in the range of about ½ inch to about 3 inches.

4. In a continuous metal-casting machine, the method for controlling the elevation level of said molten pool surface S as claimed in claims 1 or 2, in which:

said predetermined range ΔT of temperature is from about 30° F. (17° C.) to about 60° F. (33° C.) above the incoming coolant temperature.

5. In a continuous metal-casting machine, the method for controlling the elevation level of said molten pool surface S as claimed in claim 4, in which:

said control-point temperature CP is near the middle of said range.

6. In a continuous metal-casting machine, the method for controlling the elevation level of said molten pool surface S as claimed in claims 1 or 2, in which:

said thermal sensing probe is a disposable probe removably mounted upon a cantilever metal spring for resiliently urging the sensitive area of said probe against the reverse face of the casting belt at said sensing point SP.

7. In a continuous metal-casting machine, the method as claimed in claim 6, wherein said disposable probe further comprises:

a streamlined shoe of carbide having a flat sole surface surrounding and flush with said sensitive area.

8. In a continuous metal-casting machine, the method as claimed in claim 6, wherein said disposable probe further comprises:

a streamlined shoe of hardened stainless steel having a flat sole surface surrounding and flush with said sensitive area.

9. In a continuous metal-casting machine, the method as claimed in claims 1 or 2, including the further steps of:

positioning the sensitive area of a second signal-producing thermal probe against the reverse face of the traveling belt at a short distance A upstream from said selected sensing point SP, and combining the signal from said second thermal probe with the signal from said first thermal probe into a unitary, single-channel signal for controlling said flow control means, whereby to expand the extent of controllable variation in the level of elevation of said pool surface S.

10. In a continuous metal-casting machine, the method for controlling the elevation level of said molten pool surface S as claimed in claim 9, in which:

said short distance A is within the range from about ½ to about 4½ inches (13mm to 114mm).

11. In a continuous metal-casting machine, the method as claimed in claims 1 or 2, including the further steps of:

positioning the sensitive area of a second signal-producing thermal probe against the reverse face of the traveling belt at a short distance A' downstream from said selected sensing point SP, and combining the signal from said second thermal probe with the signal from said first thermal probe into a unitary, single-channel signal for controlling said flow control means, whereby to expand the extent of controllable variation in the level of elevation of said pool surface S.

12. In a continuous metal-casting machine, the method for controlling the elevation level of said molten pool surfaces S as claimed in claim 11, in which:

said short distance A' is within the range from about ½ to about 4½ inches (13 mm to 114 mm).

13. In a continuous metal-casting machine, the method as claimed in claims 1 or 2, including the further steps of:

positioning the sensitive area of a second signal-producing thermal probe against the reverse face of the traveling belt at a short distance A upstream from said selected sensing point SP, positioning the sensitive area of a third signal-producing thermal probe against the reverse face of the traveling belt at a short distance A' downstream from said selected sensing point SP, and combining the signals from said second and third thermal probes with the signal from said first thermal probe into a unitary, single-channel signal for controlling said flow control means, whereby to expand the extent of controllable variation in the level of elevation of said pool surface S.

14. In a continuous metal-casting machine, the method for controlling the elevation level of said molten pool surface S as claimed in claim 13, in which:

said short distances A and A' are each within the range from about ½ to about 4½ inches (13 mm to 114 mm).

15. In a continuous metal-casting machine having an input region for introducing molten metal by injection through a close-fitting, self-sealing nosepiece into a pool P of molten metal, said casting machine employing at least one moving flexible casting belt having a front face for contact with the molten metal in said pool and a reverse face which is cooled by aqueous coolant and wherein said casting belt travels downstream in the machine for carrying metal downstream from said pool to become solidified, the method for detecting the presence of any gas void G above said pool P of molten metal comprising the steps of:

positioning the sensitive area of a signal-producing thermal probe against the reverse face of the traveling belt at a selected sensing point SP, and using the signal from said thermal probe for indicating the presence of said gas void G.

16. In a continuous metal-casting machine having an input region for introducing molten metal by injection through a close-fitting, self-sealing nosepiece into a pool P of molten metal wherein flow-control means control the rate of introducing molten metal into said pool, said casting machine employing at least one moving flexible casting belt having a front face for contact with the molten metal in said pool and a reverse face which is cooled by aqueous coolant and wherein said casting belt travels downstream in the machine for carrying metal downstream from said pool to become solidified, the method for eliminating any gas void G above said pool P of molten metal comprising the steps of:

positioning the sensitive area of a signal-producing thermal probe against the reverse face of the traveling belt at a selected sensing point SP, and using the signal from said thermal probe for controlling said flow control means for controlling the rate of flow of molten metal into said pool for filling the said pool P, so as to eliminate said gas void G.

17. In a continuous metal-casting machine having an input region for introducing molten metal by injection through a close-fitting, self-sealing nosepiece into a pool P of molten metal, said casting machine employing at least one moving flexible casting belt having a front face for contact with the molten metal in said pool and a reverse face which is cooled by aqueous coolant and wherein said casting belt travels downstream in the machine for carrying metal downstream at a variably adjustable speed of motion from said pool to become solidified, the method for eliminating any gas void G above said pool P of molten metal comprising the steps of:

positioning the sensitive area of a signal-producing thermal probe against the reverse face of the traveling belt at a selected sensing point SP, and using the signal from said thermal probe for controlling said variably adjustable speed of motion for controlling the rate of carrying metal downstream from said pool P, so as to eliminate said gas void G.

18. In a continuous metal-casting machine, the method for controlling said gas cavity G as claimed in claims 15, 16 or 17, in which:

the distance of the said signal-producing thermal probe is downstream from the exit of said nosepiece with a range from zero to about 6 inches (13 mm to 76 mm).

* * * * *